US005501072A

United States Patent [19]

Plancich et al.

[11] Patent Number: 5,501,072

[45] Date of Patent: Mar. 26, 1996

[54] COMBINED CENTRIFUGAL AND PADDLE-WHEEL SIDE THRUSTER FOR BOATS

[75] Inventors: Mitchell A. Plancich, Marysville; Merall L. Thompson, Lake Stevens, both of Wash.

[73] Assignee: Pumpeller, Inc., Everett, Wash.

[21] Appl. No.: 298,027

[22] Filed: Aug. 29, 1994

[51] Int. Cl.[6] ..... B63H 11/00; B63H 25/46

[52] U.S. Cl. ..... 60/221; 60/222; 440/90; 114/151

[58] Field of Search ..... 60/222, 221; 114/151; 440/90

[56] References Cited

U.S. PATENT DOCUMENTS

| | | | |
|---|---|---|---|
| 1,489,079 | 4/1924 | Hotchkiss | 60/222 |
| 3,155,071 | 11/1964 | Buttner | 60/222 |
| 3,467,049 | 9/1969 | Turcotte | 440/90 |
| 3,557,736 | 1/1969 | Baer | 114/151 |
| 3,593,686 | 7/1971 | Cooper et al. . | |
| 3,598,078 | 8/1971 | Baer | 114/151 |
| 3,903,829 | 9/1975 | Brix | 114/151 |
| 3,903,833 | 9/1975 | Lais et al. . | |
| 4,008,676 | 2/1977 | Brix | 114/151 |
| 4,171,675 | 10/1979 | Thompson . | |
| 4,214,544 | 7/1980 | Dashew et al. . | |
| 4,265,192 | 5/1981 | Dunn . | |
| 4,411,630 | 10/1983 | Krautkremer et al. | 114/151 |
| 4,470,364 | 9/1984 | Kitaura et al. . | |
| 4,735,045 | 4/1988 | Gongwer | 60/221 |
| 4,807,552 | 2/1989 | Fowler . | |
| 4,832,642 | 5/1989 | Thompson . | |
| 5,072,579 | 12/1991 | Gongwer . | |
| 5,140,926 | 8/1992 | Denston . | |
| 5,289,793 | 3/1994 | Aker . | |

FOREIGN PATENT DOCUMENTS

| | | | |
|---|---|---|---|
| 1403925 | 11/1968 | Germany | 114/151 |

*Primary Examiner*—Richard A. Bertsch
*Assistant Examiner*—Ted Kim
*Attorney, Agent, or Firm*—Christensen, O'Connor, Johnson & Kindness

[57] ABSTRACT

A thrust propulsion mechanism (10) for a boat (12) includes an outlet conduit (22) extending athwartships from a first outlet port (16) to a second outlet port (16') in the hull (18). A paddle-wheel impeller (24) is mounted within the hull for rotation about an axis of rotation (34) by a reversible motor (30). A circumferential paddle (58) portion of the paddle-wheel impeller extends into an aperture (26) defined centrally in the top wall of the outlet conduit. An inlet conduit (20) extends athwartships from a first inlet port (14) to a second inlet port (14'), and intermediate thereof supplies water to the center of the paddle-wheel impeller. Water is discharged from the paddle-wheel impeller through one of the outlet ports, dependent on the direction of rotation of the paddle-wheel impeller, to create thrust by a combined paddle-wheel and centrifugal pump action.

19 Claims, 7 Drawing Sheets

COMBINED CENTRIFUGAL AND PADDLE-WHEEL SIDE THRUSTER FOR BOATS

FIELD OF THE INVENTION

The present invention relates to propulsion of watercraft, and particularly to side thrusters for vessel maneuvering.

BACKGROUND OF THE INVENTION

When maneuvering watercraft during docking or in other space-restricted areas, it is often desirable to be able to propel the hull of the watereraft laterally. Side thrusters have been developed that discharge directed streams of water from ports in a boat hull below the waterline, typically in the bow of the vessel. The thrust of the discharge stream creates a reaction force that propels the bow of the vessel in the opposite direction of the stream discharge.

Conventional side thrusters typically include a pump mounted within the hull of the vessel that draws water from outside the hull, and that discharges a pressurized fluid stream from a nozzle or other through-hull port. One such conventional side-thruster is disclosed by U.S. Pat. No. 3,593,686 to Cooper, which utilizes an electric motor-driven squirrel-cage type impeller to generate the thrust steam. The impeller pump draws water from a radially oriented inlet and discharges the water from a radially oriented outlet. Somewhat similar radially-fed impeller pump thrusters are disclosed by U.S. Pat. Nos. 5,289,793 to Akeer and 4,807,552 to Fowler.

Other conventional side thrusters include a propeller mounted within a conduit that produces a fluid stream for development of thrust. These include: U.S. Pat. Nos. 3,903, 833 to Lais et at.; 5,140,926 to Denston; 4,470,364 to Kitaura et at.; and 5,072,579 to Gongwer.

Such conventional side thrusters have varying degrees of efficiency, which affects both the power required to operate the thruster and the level of thrust force produced.

Many such conventional side thrusters include outlets on each side of the vessel, for selective discharge of a thrust stream or streams from the port or starboard sides. Most such conventional side thrusters include a series of valves that are opened and closed to direct the thrust stream to one or the other side of the vessel.

SUMMARY OF THE INVENTION

The present invention provides a side thruster with improved efficiency and simplicity of operation. A thrust propulsion mechanism of the present invention includes a first conduit that is in fluid flow communication with an outlet port defined in the boat hull. A rotatable paddle-wheel impeller is mounted with a circumferential paddle portion extending into an aperture formed in the first conduit to be closely received by the first conduit. A second conduit is in fluid flow communication with an inlet port defined in the boat hull and with the paddle-wheel impeller to supply water to the paddle-wheel impeller. A motor drives the paddle-wheel impeller.

In a further aspect of the present invention, a thrust propulsion mechanism is provided that includes a conduit extending from a first through-hull port to a second through-hull port. A paddle-wheel impeller is rotatable about an axis of rotation and mounted with a circumferential paddle portion extending into an aperture defined in a side wall of the conduit. A reversible motor selectively rotates the paddle-wheel impeller in a first or second direction. A fluid supply supplies fluid to the axial center of the paddle-wheel impeller, wherein the fluid is discharged from the paddle-wheel impeller into the conduit to one of the first or second through-hull ports, depending on the direction of rotation, by a combined impeller and paddle-wheel action.

The present invention also provides a method for producing thrust for maneuvering the hull of the watercraft, which involves supplying water to the center of a paddle-wheel impeller that is rotatably mounted within a watercraft. The water is discharged from the paddle-wheel impeller into a conduit that closely receives a circumferential paddle portion of the paddle-wheel impeller projecting into the conduit through an aperture defined therein. The paddle-wheel impeller is rotated to discharge a combined impeller and paddle-wheel-driven stream of water from the conduit through the hull.

The side thruster of the present invention has improved efficiency due to the use of a combined paddle-wheel impeller. In the preferred embodiment, the paddle-wheel impeller receives an inlet water stream through the impeller's axial center, and discharges the stream from the radial side of the impeller, thus imparting centrifugal force on the water for propulsion of the stream. One side of the paddle-wheel impeller is received within an aperture in the outlet conduit, and as water is drawn through the conduit, energy is imparted by the turning of the paddle blades through the water stream. This combined centrifugal and paddle-wheel action enables production of a thrust stream over a broad range of operating speeds of the paddle-wheel impeller. At low speeds, the paddle-wheel action is predominant, while at higher speeds, the centrifugal impeller pump action is predominant. At intermediate speeds, both actions are useful in generating thrust. The result is that an equivalent thrust can be generated with a slower operation of the motor that drives the paddle-wheel impeller as compared to conventional pumps.

The direction of discharge of the thrust stream is determined by the direction of rotation of the paddle-wheel impeller, with water being drawn into the hull through one side of the inlet conduit and being discharged through the opposite side of the inlet conduit. The need for valves to direct the thrust stream is eliminated.

BRIEF DESCRIPTION OF THE DRAWINGS

The foregoing aspects and many of the attendant advantages of this invention will become more readily appreciated by reference to the following detailed description taken in conjunction with the accompanying drawings, wherein.

DETAILED DESCRIPTION OF THE PREFERRED EMBODIMENT

Figure 1:
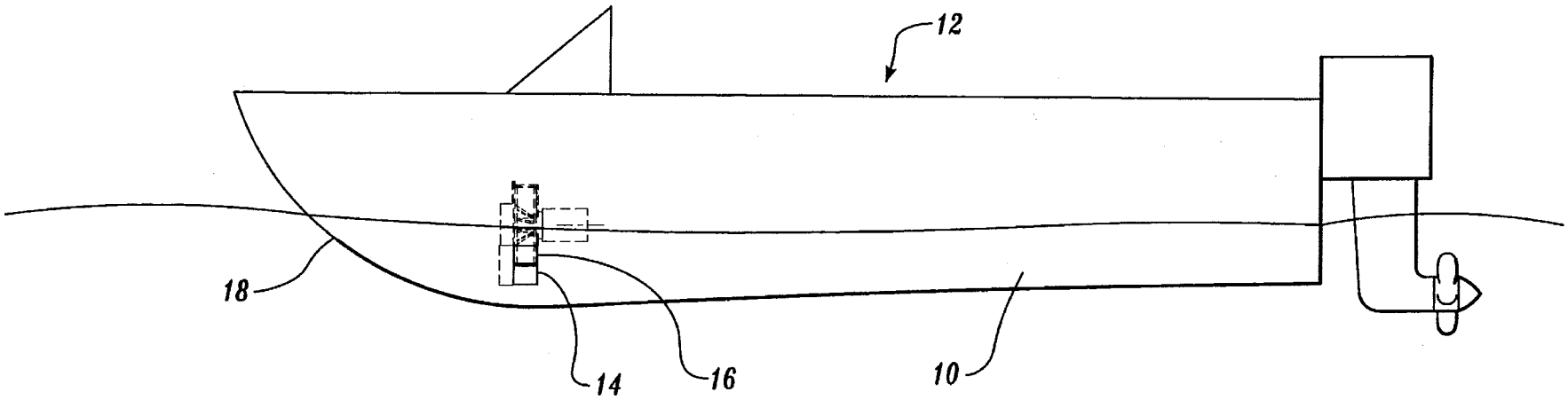
FIG. 1 provides a schematic side elevation view of a boat including a first preferred embodiment of a side thruster constructed in accordance with the present invention mounted within the bow.

A first preferred embodiment of a side thruster 10 constructed in accordance with the present invention is shown mounted within the bow of a boat 12. The side thruster 10 is in fluid communication with inlet ports 14 and outlet ports 16 formed in each of the starboard and port sides of the hull 18 of the boat, below the water line.

Figure 2:
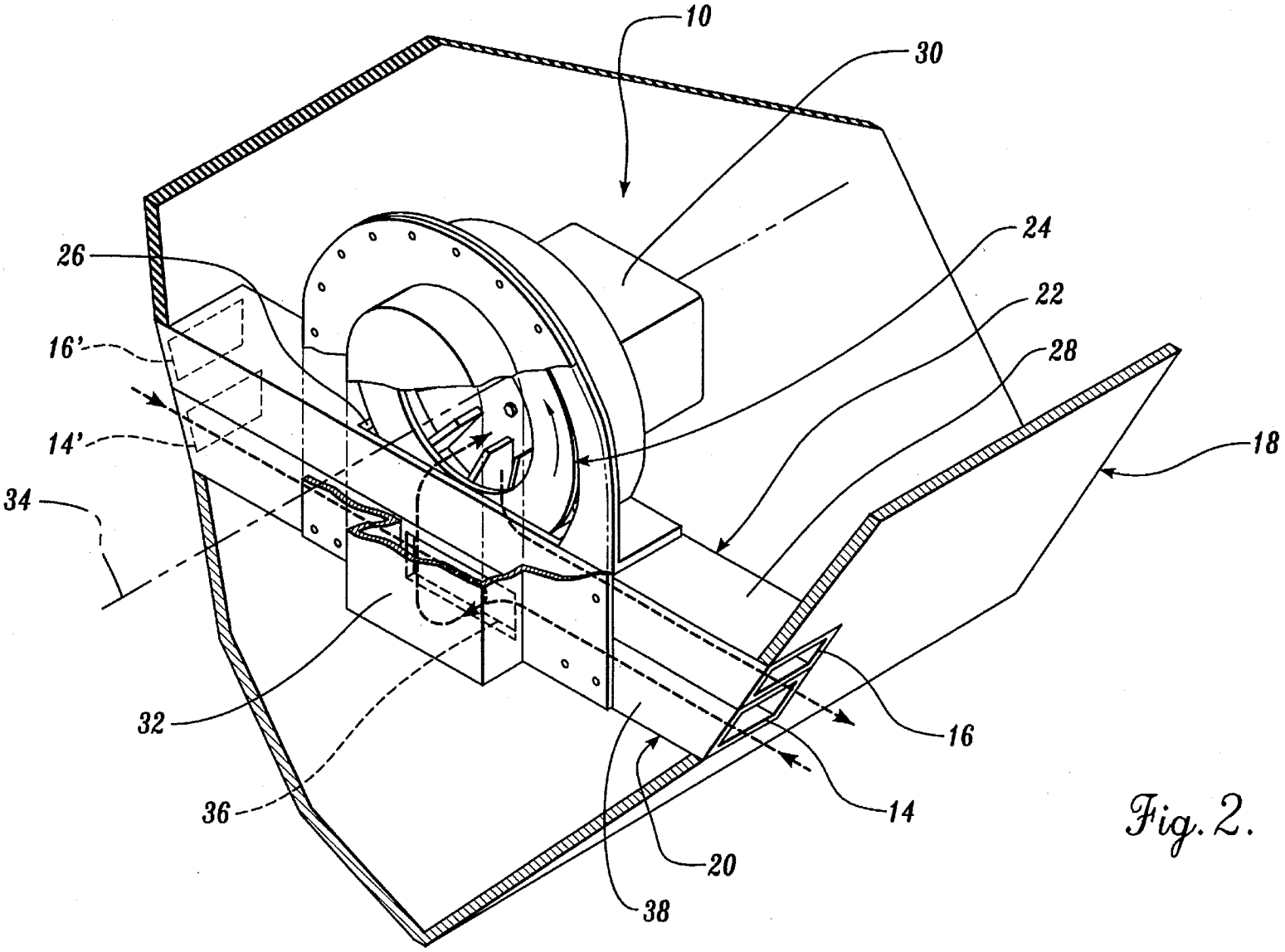
FIG. 2 provides a pictorial view of the first preferred embodiment of the side thruster of the present invention shown in FIG. 1, with a major portion of the boat hull being broken away for clarity.

Referring to FIG. 2, the side thruster 10 includes an elongate inlet conduit 20 that is horizontally disposed and runs athwartships of the bow, opening at each end to define the inlet ports 14. An outlet conduit 22 is disposed parallel to and oriented on top of the inlet conduit 20, and opens at each end to define the outlet ports 16. The outlet ports 16 shall hereafter be referred to individually as a port side outlet port 16 and a starboard outlet port 16', and collectively are referred to as the outlet ports 16. The inlet ports 14 shall be referred to as the port side inlet port 14 and starboard inlet port 14', and collectively as the inlet ports 14.

A paddle-wheel impeller 24 is mounted for rotation with one circumferential side of the paddle-wheel impeller 24 projecting through an aperture 26 formed in the top wall 28 of the outlet conduit 22. The paddle-wheel impeller 24 is rotatably driven by a motor 30. Water is supplied to the center of the paddle-wheel impeller 24 from the inlet conduit 20 through a duct 32. When the paddle-wheel impeller 24 is rotated in a counterclockwise direction about its axis of rotation 34, as shown in FIG. 2, a thrust stream is generated that exits the port side outlet port 16. Water is drawn into the paddle-wheel impeller 24 through both the port side and starboard inlet ports 14 and 14', respectively, as well as the starboard outlet port 16'. Energy in the form of centrifugal force is imparted to water entering the center of the paddle-wheel impeller 24 from the inlet conduit 20 and duct 32. The paddle-wheel impeller 24 also imparts energy by a paddle-wheel action on water being drawn in through the starboard outlet port 16'. These combined streams exit the port side outlet port 16 to produce thrust for maneuvering the hull 18 of the boat 12.

The detailed construction of the side thruster 10 will now be described with reference to both FIGS. 2 and 3. Each of the inlet conduit 20 and outlet conduit 22 are preferably formed from rectangular conduit tubing, such as stainless steel, aluminum, fiberglass, thermoplastic, or other polymer tubing. The interior passages defined by each of the conduits 20 and 22 have rectangular profiles. The ends of the inlet and outlet conduits 20 and 22 are sealed to the hull 18 using conventional through-hull fitting techniques, as is well known to those of ordinary skill in the art of hull construction. Each of the inlet conduit 20 and outlet conduit 22 are mounted horizontally and run athwartships the hull 18. In the preferred embodiment of FIGS. 2 and 3, the outlet conduit 22 is stacked directly on top of the inlet conduit 20.

The internal flow passage defined by the inlet conduit 20 is equal in width, but larger in height, than the internal flow passage defined by the outlet conduit 22. This larger dimensioning of the inlet conduit is to minimize pressure drop in water drawn into the paddle-wheel impeller 24. The exact dimensions of the inlet conduit 20 and outlet conduit 22 are determined based on the size and weight of the hull 18 to be maneuvered. For small recreational water craft, suitable conduit dimensions are an internal width of 1 inch to 5 inches by an internal height of 1 inch to 5 inches. Most preferably, it has been found suitable to use an inlet conduit 20 having an internal passage measuring 3 inches high by 3 inches wide, and an outlet conduit 22 having an internal passage measuring 2 inches high by 3 inches wide. These dimensions are found suitable for use with a paddle-wheel impeller 24 having a diameter of approximately 10 inches. These various dimensions are provided by way of example only, and can be readily scaled up or down to generate the desired level of thrust.

Water supplied through the inlet conduit 20 passes through an aperture 36 formed centrally in the front side wall 38 of the inlet conduit 20. As used herein throughout, "front" and "forward" refers to the direction facing the bow of the boat 12, while "back" and "rearward" refer to the direction facing the stem of the boat 12. Water flowing through the aperture 36 is received within the duct 32, which is formed to define a recessed conduit portion 40 that is surrounded by a flange portion 42. The conduit portion 40 has a vertically oriented forward wall that is joined to the flange portion 42 by a surrounding side wall. Thus the forward wall of the conduit portion 40 is spaced from the inlet and outlet conduits 20 and 22, thereby defining a vertically oriented flow passage between the duct 32 and the front walls of the inlet conduit 20 and outlet conduit 22. The flange portion 42 of the duct 32 is sealed to the front walls of the inlet conduit 20 and outlet conduit 22. The duct 32 projects upwardly above the top wall 28 of the outlet conduit 22, and mates with a housing 44 of the paddle-wheel impeller 24 that is mounted on the top wall 28 of the outlet conduit 22.

The housing 44 defines a partial cylindrical recessed portion 46 having a vertically oriented back wall and a surrounding side wall. The recessed portion 46 closely receives the paddle-wheel impeller 24. The housing 44 further includes a surrounding flange portion 48 that mates with the flange portion 42 of the duct 32 and with the top wall 28 of the outlet conduit 22. The flange portion 48 of the housing 44 is secured to the flange portion 42 of the duct 32 and to the outlet conduit 22 by a plurality of bolts 50. The duct 32 and housing 44 are sealed by conventional means, such as by the use of an elastomeric gasket. Water thus flows into the inlet ports 14 through the inlet conduit 20, passing through the aperture 36 defined therein and rising upwardly within the duct 32. Water is supplied by the upper portion of the duct 32 to the axial center of the paddle-wheel impeller 24.

The paddle-wheel impeller 24 is received for rotation within the housing 44 and is secured by a plurality of bolts 52 to the end of a short drive shalt 54 projecting from the motor 30. The drive shaft 54 passes through an aperture formed in the back wall of the housing 44. The motor 30 is secured to the housing 44 by bolts 55. The drive shaft 54 and paddle-wheel impeller 24 rotate on the axis of rotation 34, which is oriented horizontally, perpendicular to, and spaced above the longitudinal axes of the inlet conduit 20 and the outlet conduit 22.

The paddle-wheel impeller 24 is constructed to provide a dual paddle-wheel and centrifugal impeller action. The paddle-wheel impeller 24 includes a circular back plate 56 to which a plurality of paddle fins 58 are secured. Each paddle fin 58 is radially oriented on the back plate 56 and is secured on edge, such as by welding, to the back plate 56. Each paddle fin 58 thus projects perpendicularly from the back plate 56. The paddle fins 58 are spaced at even arcuate intervals about the perimeter of the back plate 56, with the radially outer edge of each paddle fin 58 aligning with the perimeter of the back plate 56. The radial length of each paddle fin 58 is less than the radius of the back plate 56, such that an unobstructed center portion 60 of the back plate 56 remains. Each paddle fin 58 has a generally rectangular profile, except that a radially inner forward comer of the paddle fin 58 is beveled inwardly towards the center portion 60 of the back plate 56, thereby further providing fluid flow access to the center portion 60 of the back plate 56. Each paddle fin 58 has a constant thickness and a constant axial width, except for the beveled forward inner comer. The paddle fins 58 thus each present a blunt driving surface during rotational passage through the outlet conduit 22.

The paddle-wheel impeller 24 is completed by an annular ring plate 62 that is coaxially aligned with the back plate 56, and that is secured to the forward edges of the paddle fins 58, such as by welding. The outer diameter of the ring plate 62 is substantially equal to the diameter of the back plate 56. The ring plate 62 defines a central aperture 64 which permits passage of water from the duct 32 to the center of the paddle-wheel impeller 24. The radial width of the ring plate 62 is determined so as to not obstruct the flow of water into the center of the paddle-wheel impeller 24. The paddle-wheel impeller 24 is made of a corrosion resistant material. Suitable materials include anodized aluminum, stainless steel, fiberglass, thermoplastic, or other materials.

A lower arcuate paddle portion of the paddle-wheel impeller 24 projects inwardly into the outlet conduit 22 through the aperture 26 formed therein. The axial width of the paddle-wheel impeller 24 is slightly less than the width of the internal flow passage of the outlet conduit 22. The paddle fins 58 are dimensioned such that their radial length is greater than the height of the internal flow passage of the outlet conduit 22. The profile of the paddle fins 58 substantially matches the profile of the internal flow passage of the outlet conduit 22, as shall be described subsequently in greater detail. Thus, during rotation of the paddle-wheel impeller 24, the lower-most paddle fins 58 pass into and sweep through the internal flow passage of the outlet conduit 22. The paddle fins 58 rotating through the outlet conduit 22 draw water through a first one of the outlet ports 16 (determined by the direction of rotation), and propel the water outwardly through the opposing outlet port 16 of the outlet conduit 22 in a direction tangential to the rotation of the paddle-wheel impeller 24. This paddle-wheel affect is most predominant at low speeds of operation of the motor 30.

At the same time, the paddle-wheel impeller 24 acts as a centrifugal pump, drawing water in through both of the inlet ports 14 of the inlet conduit 20 into the axial center of the paddle-wheel impeller 24. Centrifugal energy is imparted to this stream of water, which also exits tangentially from the side of the paddle-wheel impeller 24 through the outlet conduit 22. At higher speeds of operation of the motor 30, the centrifugal force effect of the paddle-wheel impeller 24 predominates.

Thus, water is drawn through both inlet ports 14 and one outlet port 16, and exits the remaining outlet port 16 to create a directed high velocity stream of water. The combined paddle-wheel and impeller action results in the generation of a thrust stream with a high degree of efficiency, thereby requiring slower operation speeds of the motor 30 for a given desired thrust, and creating a higher degree of thrust for a given rotation. Because of the combined paddle-wheel and centrifugal action, the side thruster 10 operates efficiently over a broad range of operating speeds.

The motor 30 may be hydraulic, electrical, steam driven, or pneumatic. Alternately, other drive sources could be utilized, such as a power takeoff from an inboard engine. The direction of discharge of a thrust stream on the starboard or port side of the hull 18 is controlled by selecting the direction of rotation of the paddle-wheel impeller 24. Thus, the motor 30 is selectively reversible, allowing rotation in either a counterclockwise or clockwise direction to produce thrust from the starboard or port side.

Figure 3:
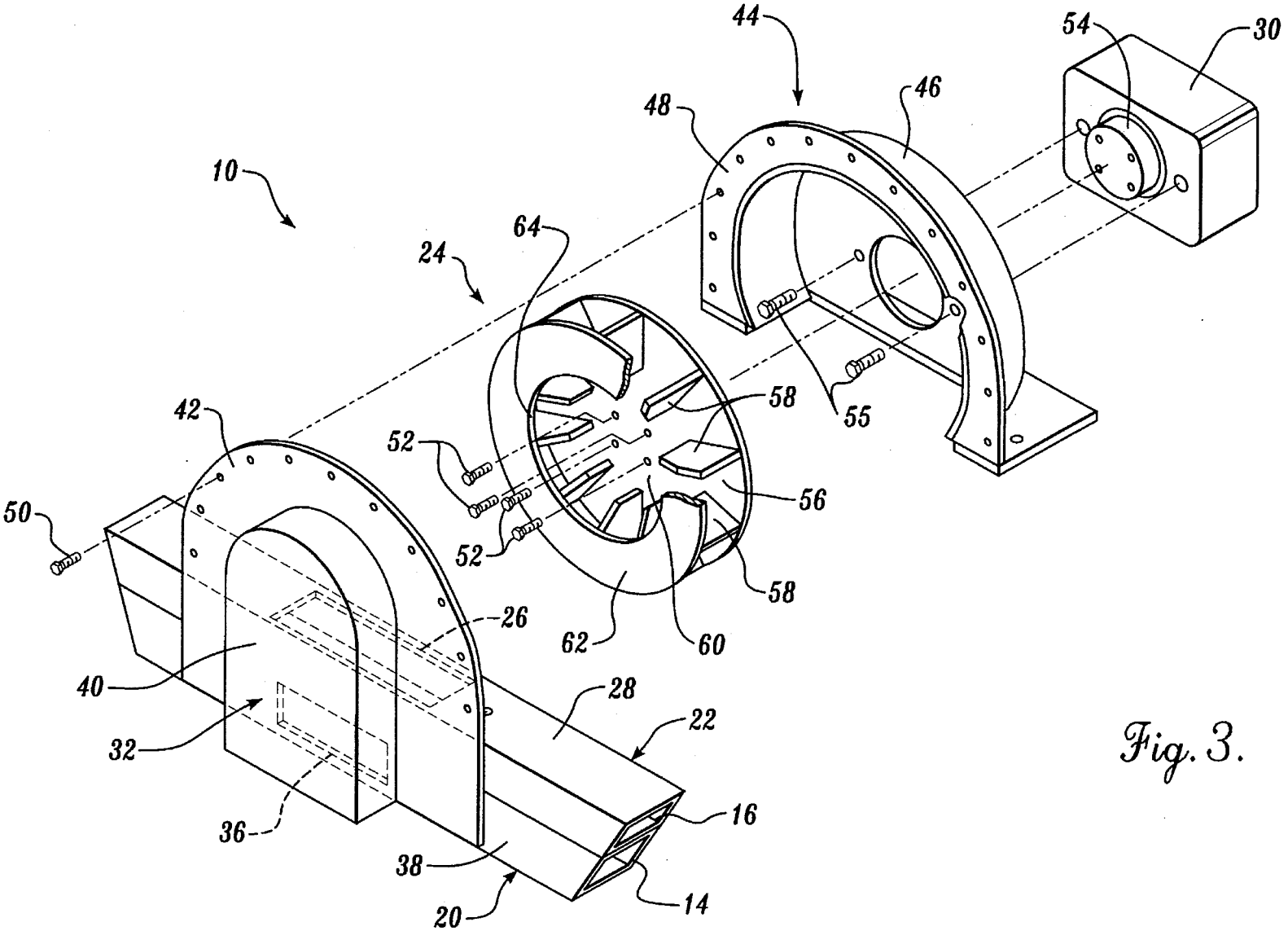
FIG. 3 provides an exploded pictorial view of the paddle-wheel impeller thruster of FIG. 2.
Figure 4:
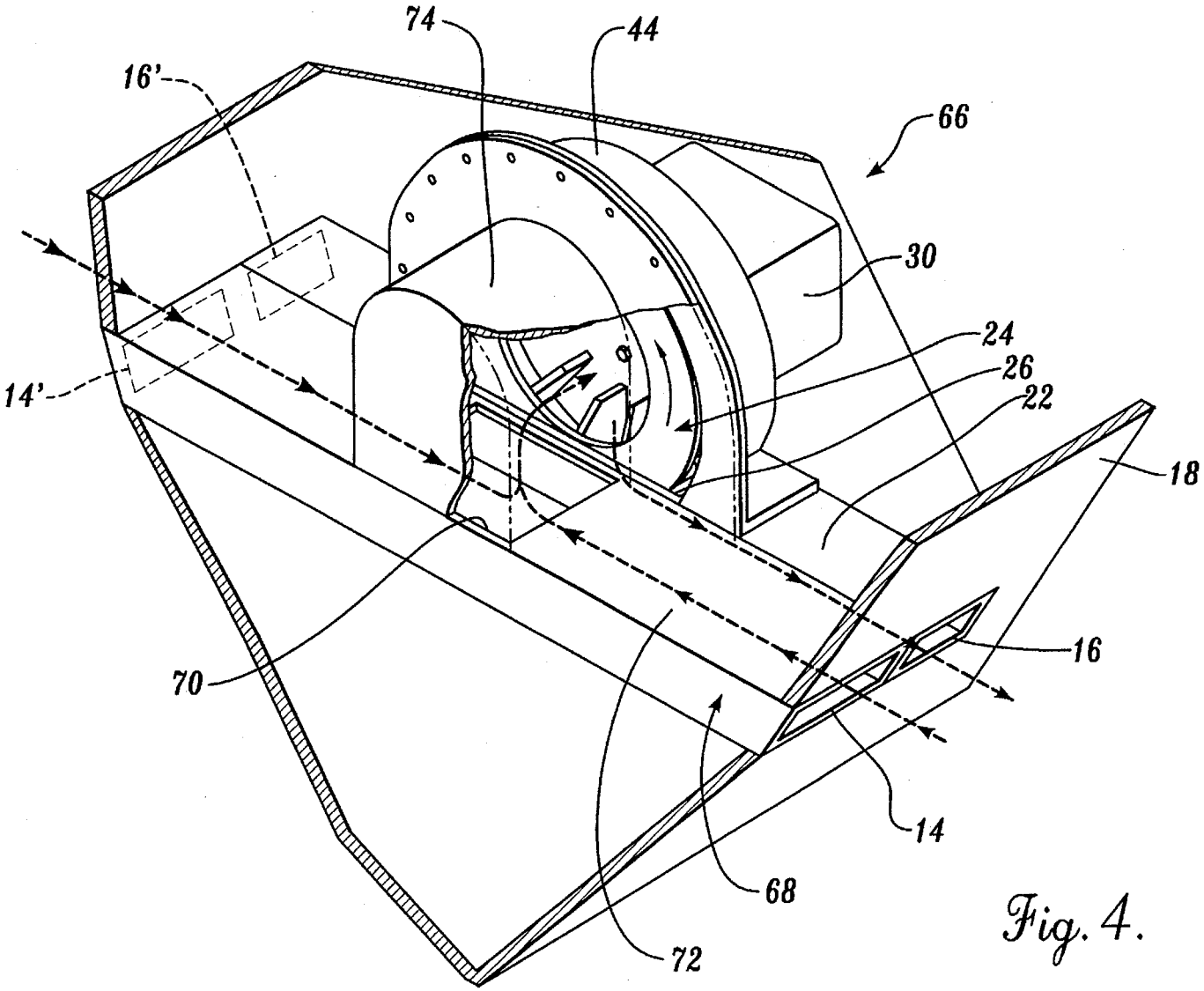
FIG. 4 provides a pictorial view of an alternate embodiment of a side thruster of the present invention again mounted within a boat hull that is broken away in part for clarity.
Figure 5:
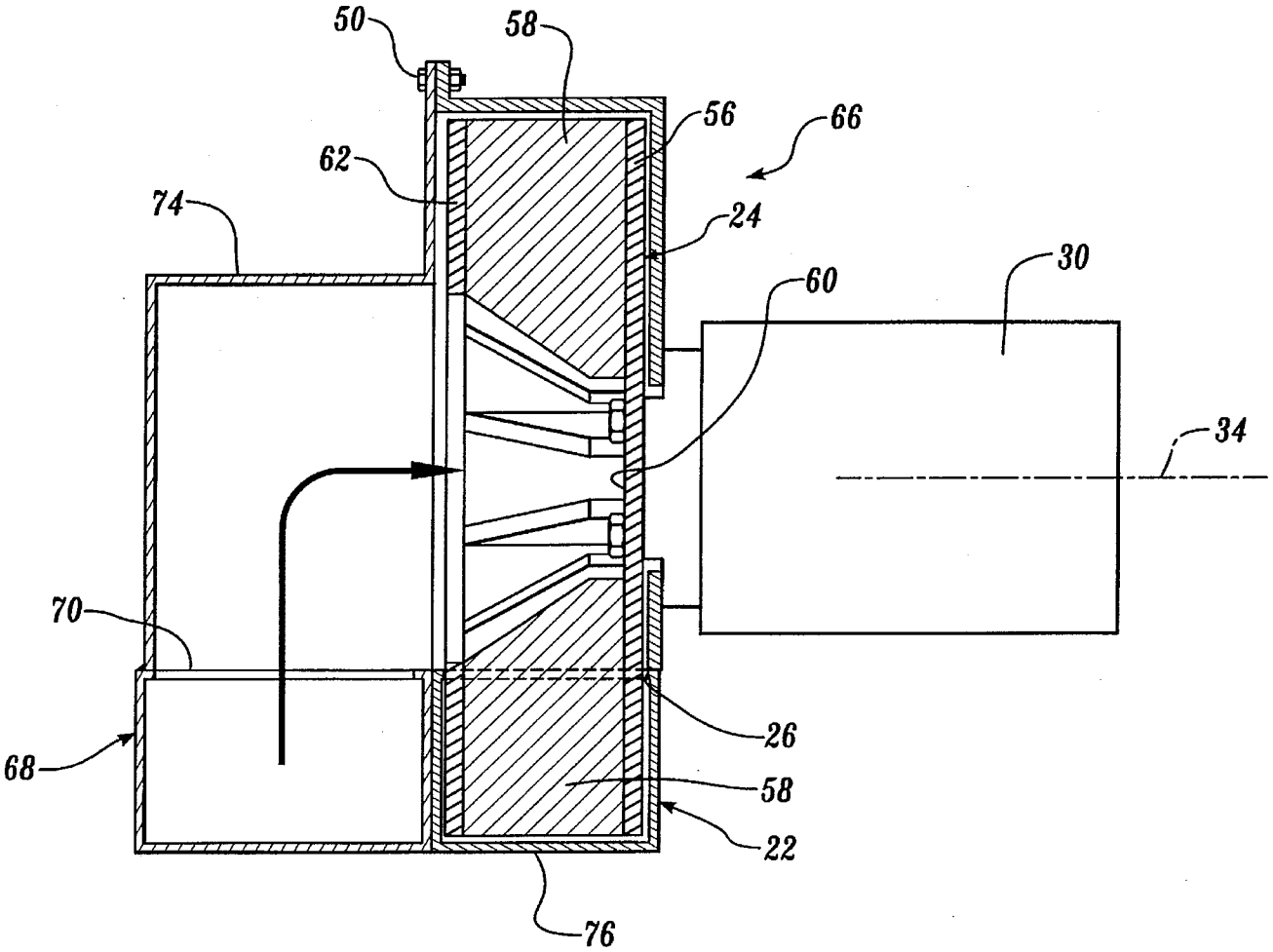
FIG. 5 illustrates a cross-sectional view of the combined paddle-wheel impeller of FIG. 4 taken substantially along a vertical plane aligned with the rotational axis of the paddle-wheel impeller.

While a vertically stacked outlet conduit 22 and inlet conduit 20 have been illustrated in FIGS. 1–3, other arrangements for the inlet and outlet conduits 20 and 22 are possible. An alternate embodiment of a side thruster 66 illustrated in FIGS. 4–5 represents another method of supplying water to the center of the paddle-wheel impeller 24 in accordance with the present invention. This alternate side thruster 66 is identically configured to the previously described side thruster 10 of FIGS. 2 and 3, except as noted. Thus, like parts and features are referred to using the same reference numerals, and description of redundant aspects is avoided. The paddle-wheel impeller 24, housing 44, outlet conduit 22, and motor 30 are disposed within the hull 18, as previously described. However, an inlet conduit 68 is disposed in front of and parallel to the outlet conduit 22, rather than being disposed below the outlet conduit 22. The inlet conduit 68 and outlet conduit 22 are equal in height, but the inlet conduit 68 has a greater width.

An aperture 70 is formed in the center of the top wall 72 of the inlet conduit 68. A duct 74 is secured to the top of the inlet conduit 68 to provide passage of water from the aperture 70 to the center of the paddle-wheel impeller 24. The duct 74 is configured the same as previously described duct 32, except that it has a greater axial width, and rises from the top wall 72 rather than the front wall of the inlet conduit 68.

The paddle-wheel impeller 24 includes a back plate 56, paddle fins 58, and a ring plate 62, and is received within an aperture 26 of the outlet conduit 22, in the same manner as previously described for the side thruster 10. This construction and corresponding fit is best viewed in FIG. 5. The axial profile of the lower circumferential paddle-portion of the paddle-wheel impeller 24 that is received within the outlet conduit 22 closely matches the transverse profile of the internal flow passage of the outlet conduit 22. Thus, the axial profile of the portion of each paddle fin 58 that is received within the outlet conduit 22 is rectangular. A small clearance, such as 1/16 inch to 1/4 inch, and preferably 1/8 inch, is provided around the bottom, front and back sides of the paddle-wheel impeller 24 relative to the interior of the outlet conduit 22. The perimeter of the paddle-wheel impeller 24, and thus the radial edges of the paddle fins 58, closely approach the bottom wall 76 of the outlet conduit 22. This provides for the efficient sweep of water through the outlet conduit 22 by the passing paddle fins 58. The axial width of the paddle fins 58 is constant for the full height of the outlet conduit 22, beveling towards the center portion 60 of the back plate 56 only above the outlet conduit 22.

Figure 6:
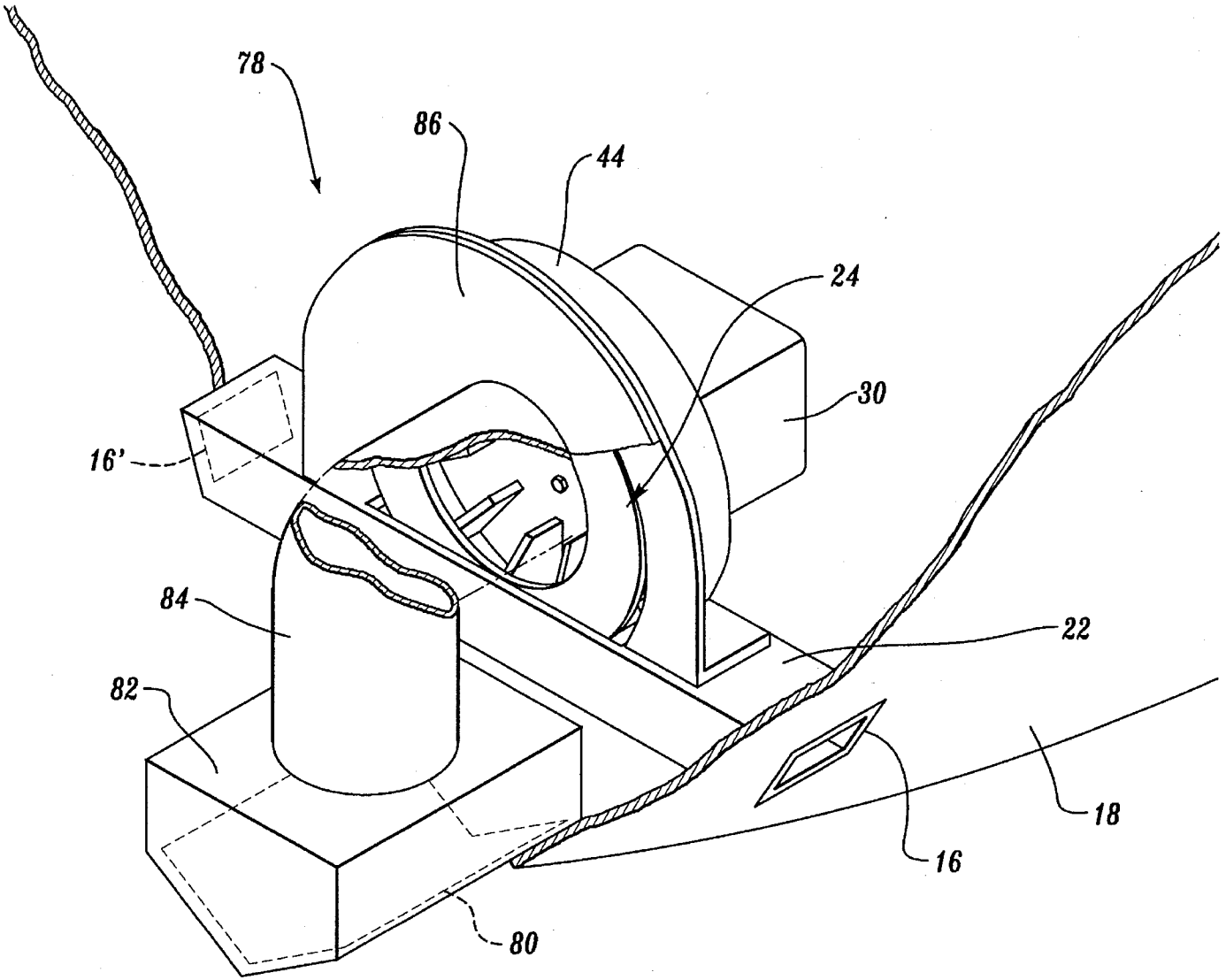
FIG. 6 provides a pictorial view of a further alternate embodiment of the side thruster of the present invention again mounted within the boat hull that is predominantly broken away for clarity.
Figure 7:
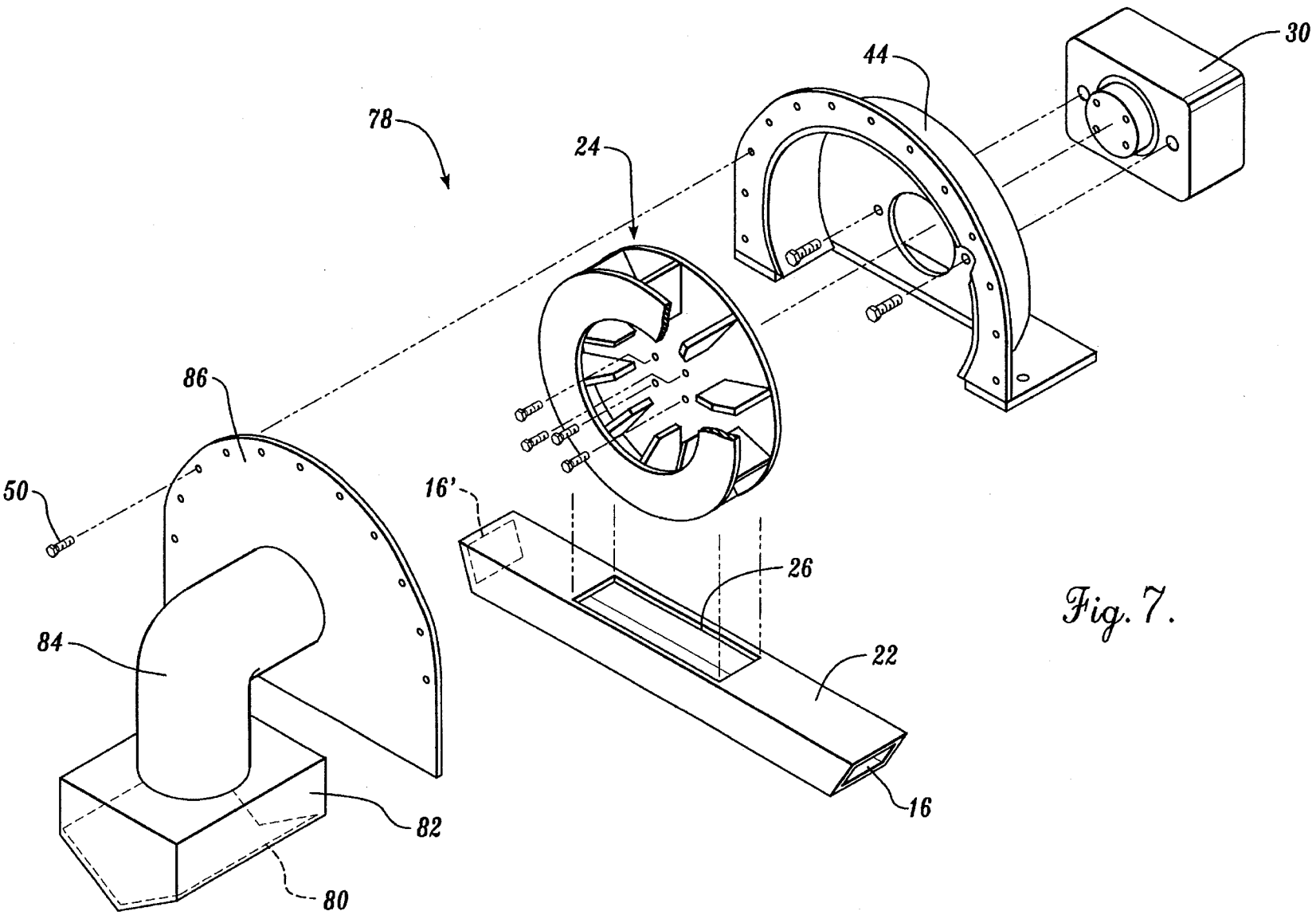
FIG. 7 provides an exploded pictorial view of the paddle-wheel impeller of FIG. 6.

A further alternate embodiment of a side thruster 78 is illustrated in FIGS. 6 and 7. Side thruster 78 is identically configured to the previously described side thruster 10, except for the manner in which water is supplied to the axial center of the paddle-wheel impeller 24. Thus again, identical reference numerals are used to refer to identical parts and features of the side thruster 78. The side thruster 78 includes the paddle wheel impeller 24, outlet conduit 22, housing 44, and motor 30, as previously described. The outlet conduit 22 defines first and second outlet ports 16, as previously described. However, rather than a parallel inlet conduit 20 defining first and second inlet ports 14, a single inlet port 80 is defined by a sea chest 82.

The sea chest 82 is mounted in the bottom of the hull 18, which in the embodiment illustrated is a V-hull, and is sealed about its periphery to the hull 18. Water is drawn through the sea chest 82 into an inlet conduit 84 that extends upwardly and then bends horizontally to mate with the center of the paddle-wheel impeller 24. A flange 86 secured to the upper end of the inlet conduit 84 is secured to and sealed against the housing 44 of the paddle-wheel impeller 24. The upper portion of the inlet conduit 84 is axially aligned with the paddle-wheel impeller 24. Operation of the side thruster 78 is the same as that previously described for the side thruster 10, except that water is supplied through the single inlet port 80, rather than dual inlet ports. In either case, the direction of rotation of the paddle-wheel impeller 24 determines from which of the outlet ports 16 the thrust stream is discharged.

While the previously described side thrusters 10, 66 and 78 have been described as including paddle-wheel impellers that are mounted to rotate about a horizontal axis, it should be apparent to those of ordinary skill, based on the disclosure contained herein, that the paddle-wheel impeller 24 could alternately be mounted to rotate on a vertical axis. Thus, for example, the side thruster 78 illustrated in FIGS. 6 and 7 could be modified so that the paddle-wheel impeller 24 and motor 30 are mounted for rotation on a vertical axis. In that case (not shown), the paddle-wheel impeller 24 would rest on top of and be supplied by an inlet conduit projecting straight upwardly from the sea chest 82, with a circumferential side portion of the paddle-wheel impeller 24 being received through an aperture formed in a side wall of a horizontally oriented outlet conduit 22.

It is also possible to make further modifications of the disclosed preferred embodiments while keeping within the scope of the present invention. For example, the previously described side thrusters 10, 66 and 78 have been described as being mounted within the bow of the boat to produce bow thrust. However, it should be readily apparent that these side thrusters could alternately be mounted within the stern of the vessel. The thrusters 10, 66 and 78 of the present invention are effective at producing a propulsion thrust when arranged in fluid-flow communication and for paddle-wheel action with a conduit system extending from a desired inlet port or ports to a desired outlet port or ports to propel the hull of the boat in the direction desired.

While the preferred embodiment and several alternate embodiments of the invention have been illustrated and described, it will be appreciated that various changes can be made therein without departing from the spirit and scope of the invention. It is thus intended that the scope of letters patent granted hereon be limited only by the definitions contained in the appended claims.

The embodiments of the invention in which an exclusive property or privilege is claimed are defined as follows:

1. A method for producing thrust for maneuvering the hull of a water craft on a body of water, comprising:

supplying water from an inlet to the center of a paddle-wheel impeller rotatably mounted within the water craft;

discharging water from the paddle-wheel impeller into a discharge comprising tubular conduit that closely receives a circumferential paddle portion of the paddle-wheel impeller projecting into the tubular conduit through an aperture defined therein; and rotating the paddle-wheel impeller to discharge a combined impeller and paddle-wheel driven stream of water from the conduit through the hull, where the direction of discharge is dependent on the direction of rotation of the impeller.

2. The method of claim 1, wherein water is discharged from the paddle-wheel impeller into a tubular conduit that extends from a first through-hull port to a second through-hull port, water exiting one of the first and second through-hull ports and being drawn past the paddle-wheel impeller from the other of the first and second through-hull ports.

3. A thrust propulsion mechanism for a boat having a hull, comprising:

a tubular conduit extending from a first through-hull port to a second through-hull port;

a paddle-wheel impeller rotatable about an axis of rotation and mounted with a circumferential paddle portion extending into an aperture defined in a side wall of the tubular conduit;

a reversible motor for selectively rotating the paddle-wheel impeller in a first or second direction; and a fluid supply for supplying fluid to the axial center of the paddle-wheel impeller, wherein the fluid is discharged from the paddle-wheel impeller into the tubular conduit, flowing through the tubular conduit to one of the first or second through-hull ports, depending on the direction of rotation, by a combined impeller and paddle-wheel action.

4. The mechanism of claim 3, wherein when the discharge of the paddle-wheel impeller exits through one of the first or second through-hull ports, fluid is drawn past the paddle-wheel impeller through the other of the first or second through-hull port.

5. The mechanism of claim 3, wherein the circumferential paddle portion of the paddle-wheel extends into the conduit to approach an opposite side wall of the conduit.

6. The mechanism of claim 3, wherein the conduit defines a longitudinal axis that is oriented perpendicular to the axis of rotation of the paddle-wheel impeller.

7. The mechanism of claim 3, wherein the paddle-wheel impeller comprises a plate mounted centrally for rotation on the axis of rotation and a plurality of radially oriented paddles secured to the plate at spaced arcuate intervals about the periphery of the plate, the paddles surrounding an unobstructed central portion of the plate to which fluid is supplied from the fluid supply.

8. A thrust propulsion mechanism for a boat having a hull defining an inlet port and an outlet port, the mechanism comprising;

a discharge comprising a tubular first conduit in fluid flow communication with the outlet port;

a rotatable paddle-wheel impeller mounted with a circumferential paddle portion extending into an aperture formed in the tubular first conduit to be closely received by the first conduit;

an inlet comprising a tubular second conduit in fluid flow communication with the inlet port and with the paddle-wheel impeller to supply water to the paddle-wheel impeller; and a reversible motor drivingly coupled to the paddle-wheel impeller to drive rotation of the paddle-wheel impeller, where said inlet and discharge are dependent on the direction of rotation of the paddle-wheel impeller.

9. The mechanism of claim 8, wherein the paddle-wheel impeller includes a plurality of radially oriented fins, each fin having a profile that is complementary to an internal profile of the first conduit.

10. The mechanism of claim 9, wherein the paddle-wheel impeller comprises a solid plate mounted centrally and orthogonally on an axis of rotation of the paddle-wheel impeller and a plurality of fins, each fin secured to the plate and oriented radially relative to the axis of rotation, each fin defining a paddle of the paddle-wheel.

11. The mechanism of claim 10, wherein each fin has a radial length that is less than the radius of the plate, thereby defining an unobstructed center portion of the plate that receives water from the second conduit.

12. The mechanism of claim 8, wherein the paddle-wheel impeller is mounted to rotate about an axis of rotation, and the first conduit defines a longitudinal axis that is oriented perpendicular to the axis of rotation of the paddle-wheel impeller.

13. The mechanism of claim 8, wherein the second conduit supplies water to the center of the paddle-wheel impeller.

14. The mechanism of claim 8, wherein:

the first conduit extends from a first port to a second port defined by the hull; and the motor is reversible for selective drawing of water through one of the first and second ports of the first conduit which serves as an inlet port and discharge of water through the other of the first and second ports of the first conduit which serves as the outlet port.

15. The mechanism of claim 12, wherein when water is discharged from one of the first or second ports of the first conduit, water is drawn past the paddle-wheel impeller through the other of the first or second ports of the first conduit, in supplement to the water being supplied to the paddle-wheel impeller through the second conduit.

16. The mechanism of claim 14, wherein the first conduit extends athwartships of the hull.

17. A thrust propulsion mechanism for a boat having a hull defining an inlet port and an outlet port, the mechanism comprising:

a first conduit extending in fluid flow communication from a first port to a second port defined by the hull;

a rotatable paddle-wheel impeller mounted with a circumferential paddle portion extending into an aperture formed in the first conduit to be closely received by the first conduit;

a second conduit extending from a first inlet port to a second inlet port defined in the hull and in fluid flow communication with the paddle-wheel impeller to supply water to the paddle-wheel impeller, water being supplied to the paddle-wheel impeller from both the first and second inlet ports; and a motor drivingly coupled to the paddle-wheel impeller to drive rotation of the paddle-wheel impeller, the motor being reversible for selective drawing of water through one of the first and second ports of the first conduit which serves as an additional inlet port and discharge of water through the other of the first and second ports of the first conduit which serves as the outlet port.

18. The mechanism of claim 17, wherein the first and second conduits are arranged in parallel disposition.

19. A thrust propulsion mechanism for a boat having a hull, comprising:

a paddle-wheel impeller rotatably mounted within the hull;

a motor for driving rotation of the paddle-wheel impeller;

a fluid inlet for supplying fluid to the center of the paddle-wheel impeller; and a tubular fluid outlet conduit for discharging fluid from the paddle-wheel impeller through a port defined in the hull to create thrust, wherein a circumferential side portion of the paddle-wheel impeller is received through an aperture formed in the tubular outlet conduit for a paddle-wheel action on fluid being discharged through the tubular outlet conduit, where said inlet and discharge are dependent on the direction of rotation of the paddle wheel impeller.

* * * * *

UNITED STATES PATENT AND TRADEMARK OFFICE

CERTIFICATE OF CORRECTION

PATENT NO. : 5,501,072

DATED : March 26, 1996

INVENTOR(S) : M.A. Plancich et al.

It is certified that error appears in the above-indentified patent and that said Letters Patent is hereby corrected as shown below:

| COLUMN | LINE | |
|---|---|---|
| 4 | 55 | "shalt" should read --shaft-- |
| 5 | 10 | "comer" should read --corner-- |
| 10 (Claim 19, | 30 line 7) | After "impeller;" insert --from a port in the hull-- |
| 10 (Claim 19, | 31 line 8) | Before "a" insert --a discharge comprising-- |
| 10 (Claim 19, | 36 line 13) | Before "paddle-wheel" insert --a combined impeller and-- |

Signed and Sealed this

Third Day of September, 1996

*Attest:*

*Attesting Officer*

BRUCE LEHMAN

*Commissioner of Patents and Trademarks*